United States Patent [19]

Ohashi

[11] Patent Number: 4,880,051

[45] Date of Patent: Nov. 14, 1989

[54] PIPING APPARATUS FOR MELTING SNOW AND ICE

[75] Inventor: Kazuo Ohashi, Tokyo, Japan

[73] Assignee: Kabushiki Kaisha Patine Shokai, Tokyo, Japan

[21] Appl. No.: 70,771

[22] Filed: Jul. 7, 1987

[30] Foreign Application Priority Data

| | | | |
|---|---|---|---|
| Jul. 14, 1986 | [JP] | Japan | 61-166504 |
| Jul. 14, 1986 | [JP] | Japan | 61-166505 |
| Oct. 22, 1986 | [JP] | Japan | 61-251052 |

[51] Int. Cl.[4] ..... F28D 17/00; F28D 19/00

[52] U.S. Cl. ..... 165/45; 165/46; 165/47; 165/56; 165/905; 237/1 R; 237/1 SL; 237/69; 126/271.1; 126/271.2 A

[58] Field of Search ..... 165/46, 45, 47, 49, 165/56, 10, 171, 905; 237/1 R, 1 SL, 69; 126/271.1, 271.2 A

[56] References Cited

U.S. PATENT DOCUMENTS

| | | | |
|---|---|---|---|
| 1,634,938 | 7/1927 | Funk | 165/49 |
| 2,270,745 | 1/1942 | Todd | 165/56 |
| 2,505,622 | 4/1950 | McKee | 237/1 R |
| 2,743,057 | 4/1956 | Backstrom | 237/69 |
| 3,568,924 | 3/1971 | Chenault | 237/1 R |
| 3,751,935 | 8/1973 | MacCracken et al. | 165/46 |
| 3,893,506 | 7/1975 | Laing | 165/49 |
| 3,993,122 | 11/1976 | Svenstam | 126/271.2 |
| 4,011,989 | 3/1977 | Diggs | 165/56 |
| 4,212,348 | 7/1980 | Kobayashi | 165/171 |
| 4,241,782 | 12/1980 | Schoenfelder | 165/10 |
| 4,269,172 | 5/1981 | Parker et al. | 165/56 |
| 4,388,966 | 6/1983 | Spiegel | 165/45 |
| 4,646,818 | 3/1987 | Ervin, Jr. | 165/46 |

FOREIGN PATENT DOCUMENTS

| | | | |
|---|---|---|---|
| 0259839 | 12/1985 | Japan | 237/1 R |
| 61-93502 | 6/1986 | Japan . | |
| 63-44084 | 2/1988 | Japan . | |

OTHER PUBLICATIONS

Japanese publication and summary translation from "New Engineering Handbook for Snow Protection" (no date).

*Primary Examiner*—John Ford

*Attorney, Agent, or Firm*—Frishauf, Holtz, Goodman & Woodward

[57] ABSTRACT

A piping apparatus for melting snow and ice, wherein a large number of heat radiation pipes are arranged below or above a surface from which snow or ice is to be melted and removed. One of the ends of each of the heat radiation pipes is communicated with an inlet side header arranged in a direction substantially orthogonal to the heat radiation pipes, and the other end of the pipes being communicated with an outlet side header arranged in a direction substantially orthogonal to the heat radiation pipes, thereby constituting a piping arrangement unit. The inlet side is communicated with a feed supply of a heating medium such as hot water so as to pass the supplied heating medium such as hot water through the heat radiation pipes. Heat retaining members having therein a heat accumulation material are disposed between the heat radiation pipes, whenever necessary. The apparatus can heat uniformly and economically a space adjacent the surface from which the snow and ice must be melted and removed, over a wide area or a long distance.

19 Claims, 8 Drawing Sheets

PIPING APPARATUS FOR MELTING SNOW AND ICE

BACKGROUND OF THE INVENTION

This invention relates to a piping apparatus for melting snow and ice. More particularly, the present invention relates to a piping apparatus for melting snow and ice which is suitable for preventing freezing and snowfall of a surface-like facility or surface-like structure such as a road, a bridge, the roof of a building, a parking lot, a ground, a snow dumping facility, and the like, and for melting the ice after freezing and the snow after snowfall.

Prevention of snowfall and snow removing from the roofs of houses and buildings have been made by use of electric heat in some parts of areas of high snowfall but snow removing has mostly been carried out by workers. However, this snow removing work from the roofs needs a great deal of labor every year and it has become a serious social problem because not a few accidentally drop from the roofs and are killed in the snow removing work.

On the other hand, various methods have been employed in the past in order to prevent snowfall and freezing and to melt the snow and ice in public facilities such as roads, parking lots, bridges, grounds, and the like, in areas of high snowfall and cold districts. These methods include a method which lays down sprinkler for spraying water, a method which sprays calcium chloride, a method which lays down electric heat wires under the ground to melt the snow by electric heat, a heat pipe system which melts the snow by utilizing the heat generated when a liquefied gas is boiled for evaporation at a low temperature, and so forth.

However, the sprinkler system involves the problem that the nozzles are likely to be choked up with sands and gravels and when it utilizes the underground water, the subsidence of ground is likely to occur due to dry-up of the underground water.

The spraying method of calcium chloride needs a great deal of labor for spraying and invites not only the wither of trees and grasses but also corrosion of cars due to salt. Further, the method which utilizes the electric heat consumes large quantities of electric power and is hence not practically economical.

The heat pipe system is not free from the problems in that the pipe itself is expensive, high facility investment is necessary and moreover, double facility investment is necessary because the portions into which the liquefied gas must be warmed up in the cold districts. When the terrestrial heat is used, its efficiency drops with the passage of time.

In cities, on the other hand, emergency snow removal is effected in order to prevent a traffic jam due to snowfall and the snow transported by dumping trucks are discarded into snow dumping facilities or into rivers. However, the snow dumping facilities have limited capacity and will get into saturation, while dumping of snow into the rivers will result in pollution of rivers and environment.

In the particular case of roads, a hot water pipe snow melting method has been attempted in recent years which arranges hot water pipes below the road surface, circulates the hot water from a hot water boiler through the hot water pipes to radiate the heat and thus prevents the snowfall and freeze of the road surface and melts the snow and ice. In accordance with this method, two pipes a and b are arranged in parallel with each other and are bent zigzag many times as depicted in FIG. 20(A) of the accompanying drawings and one of the ends of each pipe a, b is connected to a hot water feed pipe c with the other end being connected to a hot water return pipe d in order to circulate the hot water as represented by arrows in the drawing. Alternatively, a single pipe e is bent zigzag many times as shown in FIG. 20(B) and one of the ends of this pipe e is connected to the hot water feed pipe c while the other end is connected to the hot water return pipe d to circulate the hot water as represented by the arrows. In either case, one or two pipes are arranged zigzag below the road surface. Therefore, in order to uniformly heat a wide road, the length of the road covered is small in comparison with the length of the pipe or pipes used. If the length of the pipe(s) is increased extremely in order to increase the coverage, the temperature of the hot water drops at the end of the flowing direction of the hot water so that the road surface cannot uniformly be heated, after all, for a long distance. Moreover, even if any damage or pin-holes occur at part of the pipes, it is difficult to discover that part and a great deal of labor is necessary for maintenance and inspection.

SUMMARY OF THE INVENTION

With the background described above, the present invention is directed to provide a piping apparatus for melting snow and ice which can efficiently and readily prevent freezing and snowfall of surface-like facilities or surface-like structures such as roads, bridges, the roofs of buildings, parking lots, snow dumping facilities, grounds, and the like, can melt the ice and snow efficiently and easily after freezing and snowfall, whenever necessary, and can be laid down easily and economically.

It is another object of the present invention to provide a piping apparatus for melting snow and ice which is easy for maintenance and inspection and can be operated at a low running cost.

It is still another object of the present invention to provide a piping apparatus for melting snow and ice which can easily melt the snow and ice and can easily prevent the snowfall and freezing throughout a wide area or a long distance.

It is still another object of the present invention to provide a piping apparatus for melting snow and ice which can uniformly melt the snow and ice in a facility such as a road, and can reduce the overall cost.

BRIEF DESCRIPTION OF THE DRAWINGS

FIGS. 18, 18*a–g* is an abridged sectional view showing a different relation of the heat retaining member with the heat radiation pipe;

DESCRIPTION OF THE PREFERRED EMBODIMENTS

Figure 1:
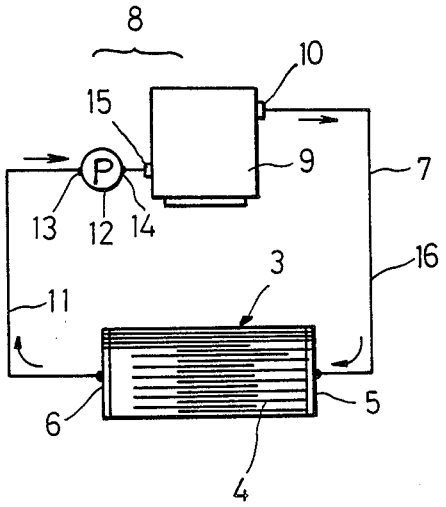
FIG. 1 is a schematic diagram of a piping apparatus in accordance with the present invention.

Hereinafter, the present invention will be described with reference to embodiments thereof shown in the drawings.

Figure 2:
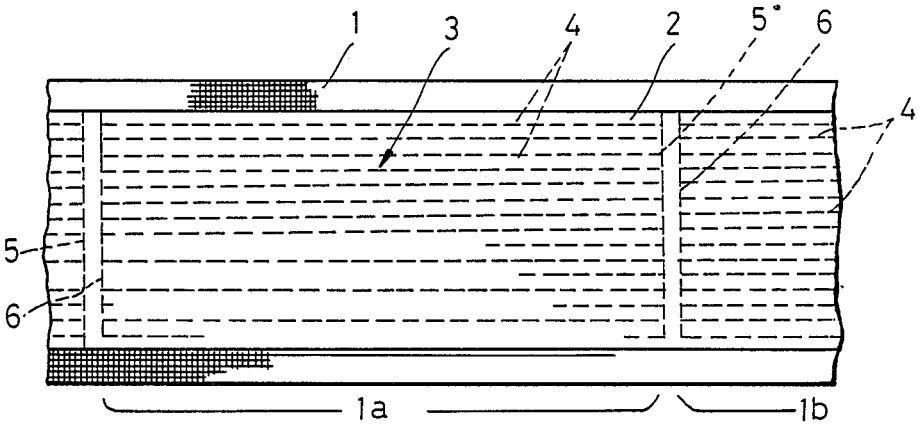
FIG. 2 is a plan view showing the state where a piping arrangement unit is disposed on a road.
Figure 3:
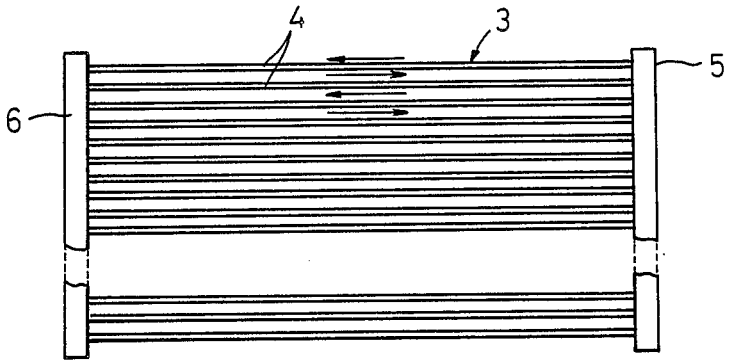
FIG. 3 is a schematic plan view showing one example of the piping arrangement unit connecting a heat radiation pipe to a header on an inlet side and a header on an outlet side.

FIGS. 1 to 3 show one embodiment wherein the present invention is applied to melting of snow and ice on the surface of a road. Reference numeral 1 represents the road paved with concrete or asphalt, for example. This road 1 is divided into a plurality of spans 1*a*, 1*b*, . . . in the longitudinal direction, and a piping arrangement unit 3 for passing a heating medium such as hot water is buried below the road surface 2 simultaneously with the pavement work.

Each piping arrangement unit 3 comprises a large number of heat radiation pipes 4 that are disposed in parallel, equidistantially space from one another, and headers 5 and 6 that are disposed in a direction substantially orthogonal to the heat radiation pipes 4. The headers 5, 6 are connected to opposite ends of pipes 4. In other words, reference numerals 4 . . . represent the heat radiation pipes that are disposed below the road surface 2 substantially in parallel with one another substantially in a straight form in the longitudinal direction of the road 1, and the inlet end of each heat radiation pipe 4 is connected to the inlet side header 5 on the inlet side that is disposed at one of the ends of each span 1*a*, 1*b*, . . . in a direction substantially orthogonal to the heat radiation pipe (in the direction of width of the road surface 1) with the outlet end being connected to the outlet side header 6 on the outlet side that is disposed at the other end of each span 1*a*, 1*b* . . . in the direction substantially orthogonal to the heat radiation pipe. The headers 5 and 6 are communicated with heating medium supply means 8 comprising a boiler 9 that serves as a generator source of heating medium and a pump 12 that sends out the heating medium to the heat radiation pipes 4 from the boiler 9. Namely, header 5 on the inlet side is connected to the outlet 10 of a boiler 9 constituting a heat medium supply means 8 through a feed pipe 7 while the header 6 on the outlet side is connected to a suction port 13 of a pump 12 constituting the heating medium supply means 8 through a return pipe 11. Furthermore, the discharge port 14 of this pump 12 is connected to the inlet 15 of the boiler 9 to form a circulation path 16 of the heating medium. Therefore, the hot water produced by the boiler 9 included in the heating medium supply means 8 flows from the feed pipe 7→header 5 on inlet side→heat radiation pipe 4→header 6 on outlet side→return pipe 11→pump 12→boiler 9 in the order named, and can heat the road surface 2 during its flow through the heat radiation pipes 4.

Each heat radiation pipe 4 can be made generally of a synthetic resin or a metal but a synthetic resin pipe or a soft steel pipe having flexibility is particularly preferably. When such a synthetic resin pipe or soft steel pipe having flexibility is used as the heat radiation pipe, the pipe can be wound so that it is easily portable and its length can be elongated. Therefore, even if the gap between the inlet side header 5 and the outlet side header 6 is elongated, there is no need for welding or forming a seam, the piping arrangement work can be made easier and accidental leakage of the heating medium due to inferior connection or welding does not occur. One example of the soft steel pipes having flexibility is a carbon steel consisting of at least 90% of Fe and having the following composition, for example:

C: 0.15 to 0.1%
Si: up to 0.01%
Mn: 0.2 to 0.5%
P: up to 0.02%
S: up to 0.02%
with the balance substantially consisting of Fe.

Figure 4:
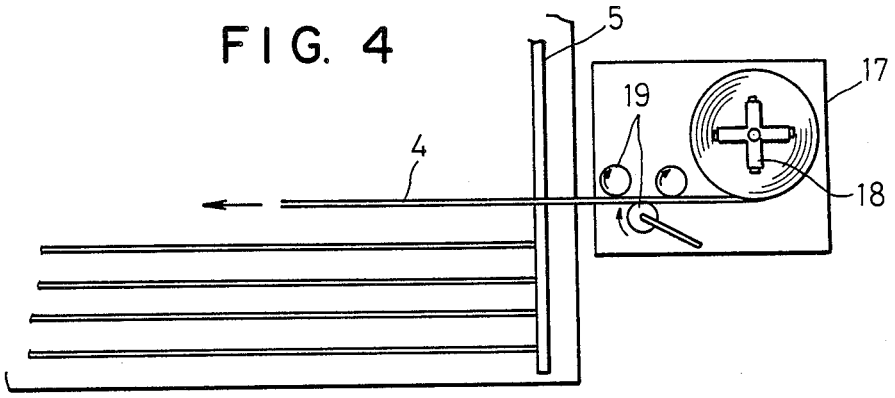
FIG. 4 is an explanatory view showing a method of arranging a heat radiation pipe made of a metal.

The heat radiation pipes 4 made of the soft steel pipe described above has flexibility and can be wound and extended by winding/delivery means 17 shown in FIG. 4. Reference numeral 18 represents a bobbin for taking up the heat radiation pipe 4 in a coil form and when this bobbin 18 is rotated to deliver the heat radiation pipe 4 in the coil form, the heat radiation pipe 4 is delivered while being corrected by pinch rollers 19 and stretched straight. Therefore, a necessary number of elongated heat radiation pipes 4 are delivered, stretched and arranged on the road 1 in its longitudinal direction in parallel with one another, and then one of the ends of each heat radiation pipe 4 is connected to the inlet side header 5 with the other end, to the outlet side header 6. Thereafter, the road surface is paved with asphalt, concrete or blocks, and the piping arrangement unit 3 can be buried immediately below the road surface 2. The piping arrangement unit 3 may be buried by soil, sand or gravel without paving.

Figure 5:
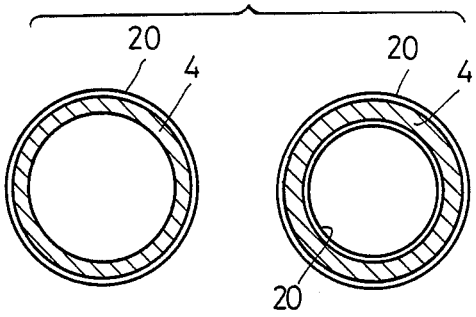
FIG. 5 is a sectional view of a preferred metal heat radiation pipe.

When the soft steel pipe described above, and other metallic pipe are used as the heat radiation pipe 4, it is preferred that a synthetic resin film 20 having corrosion resistance is applied as a coating to the outer surface or to both the inner and outer surfaces of the pipe as shown in FIG. 5. This synthetic resin coating film 20 is applied by painting, electrodeposition, coating, lamination, and the like, and different kinds of synthetic resin coating films may be applied in lamination.

When the synthetic resin pipe is used as the heat radiation pipe 4, a pipe having corrosion resistance and flexibility such as an ethylene vinyl pipe can withstand the use for an extended period, is light in weight and can therefore be transported and worked easily. Such a pipe is suitable for arrangement on the roof while kept exposed outside or for burying in the ground of a concrete pavement.

The synthetic resin as the material for the synthetic resin coating film 20 to be applied to the metallic pipe or for the synthetic resin pipe contains preferably a pigment such as carbon or titanium and a ultraviolet ray absorber or both of them in order to obtain high weatherability and high heat conductivity.

Figure 6:
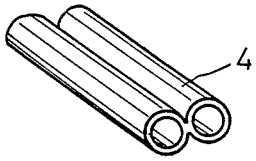
FIG. 6 is a sectional view of a two-row heat radiation pipe.

Generally, the heat radiation pipe 4 need not necessarily be a single pipe but may be double-row pipe as shown in FIG. 6. If a double-row pipe structure is used, the piping arrangement can be made easily, the flowing direction of the heating medium flowing inside the pipes can be reversed between the adjacent pipes, and the pipes can be kept equidistant.

Figure 7:
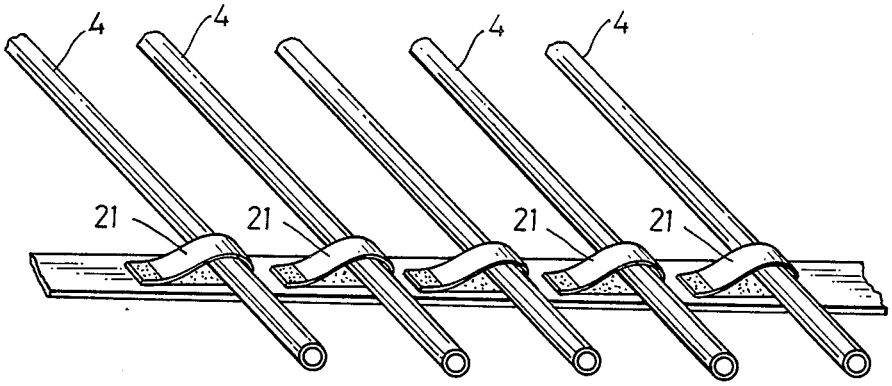
FIG. 7 is a perspective view of the heat radiation pipe held by a spacer.

A large number of heat radiation pipes 4 may be maintained with a predetermined spacing between the pipes by a plurality of spacers 21 that are disposed substantially at right angles to the heat radiation pipes 4 as shown in FIG.7. If the pipes are arranged in advance in spaced-apart form they can be transported conveniently. In addition, when the spaced pipe arrangement is laid down at a desired site and both of its ends are connected to the headers 5, 6, the piping arrangement can be carried out more efficiently and the pipes can be removed easily, too.

Figure 8:
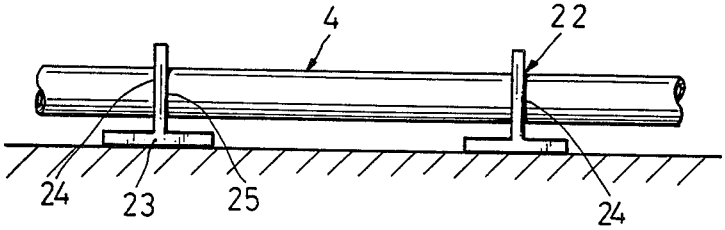
FIG. 8 is a side view of the heat radiation pipe supported by a support.

The heat radiation pipes 4 are disposed below or above the place where the snow and ice must be melted, through an adiabatic material (i.e., a sheet of heat insulating material). In this case, the heat radiation pipes 4 can be retained in position by means of supports 22 having a predetermined height as shown in FIG. 8. This support 22 comprises a belt-like base portion 23 and a support member 24 mounted on the base portion 23, and supports the heat radiation pipe 4 after the pipe 4 is fitted to suitable support means such as an engagement portion 25. If such a support 22 is used, the heat radiation pipes 4 can be held spaced apart too, and the heating action of the heating medium acts not only on the upper portion above the heat radiation pipes 4 but also below their lower portions. Therefore, this arrangement can be employed suitably for melting the snow and ice in an area of high snowfall, for example.

Figure 9:
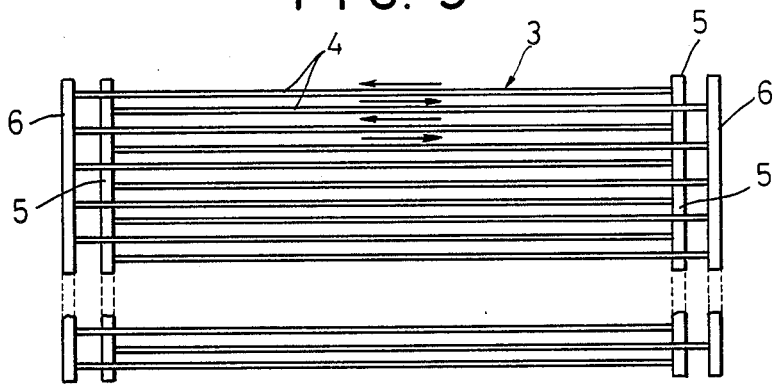
FIG. 9 is a schematic plan view showing another example of the piping arrangement unit.
Figure 10:
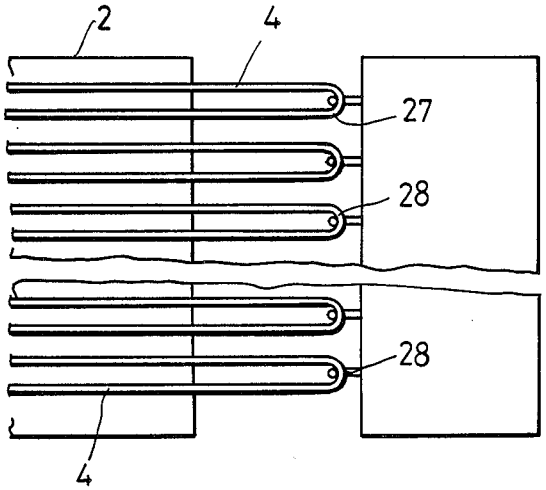
FIG. 10 is a schematic plan view showing still another example of the piping arrangement unit.

When the ends of each heat radiation pipe 4 in the piping arrangement unit 3 are connected to the headers 5, 6 on the inlet and outlet sides, they may be connected in such a manner that the flowing direction of the heating medium flowing through each heat radiation pipe 4 is the same. Preferably, however, they are connected in such a manner that the flowing directions are opposite for one or a plurality of pipes. FIGS. 9 and 10 show the examples where the flowing directions of the heating medium are different in every other heat radiation pipes 4. In FIG. 9, the headers 5 and 6 on the inlet and outlet sides are juxtaposed at both ends of each span 1*a*, 1*b* . . . where the heat radiation pipes 4 are disposed, and one of the ends of every other pipes is alternately connected to the inlet side header 5 and the outlet side header 6 with the other end being connected alternately to the outlet side header 6 and the inlet side header 5. Therefore, the flowing directions of the heating medium flowing through the heat radiation pipe 4 . . . are mutually opposite in the adjacent heat radiation pipes 4 . . . ,.

In FIG. 10, the inlet side header 5 and the outlet side header 6 are juxtaposed at one of the ends of the span 1*a*, the intermediate portion of each heat radiation pipe 4 is folded back so that one of the ends of the heat radiation pipe 4 is connected to the inlet side header 5 with the other end, to the outlet side header 6. According to this arrangement, the flowing directions of the heating medium at the intermediate portion can be reversed at the adjacent portions of a single heat radiation pipe 4. In this case, the bent portion 27 of each heat radiation pipe 4 is anchored to each hook 28 disposed at the other end of the span 1*a* so that each heat radiation pipe 4 can be secured with a predetermined spacing.

If the heat radiation pipes 4 are arranged in such a manner that the flowing directions of the heating medium are opposite for every other or a plurality of heat radiation pipes as described above, non-uniformity of heating power due to the temperature change of the heating medium during its flow can be reduced and heating can be made uniformly throughout a wide area or a long distance.

Figure 11:
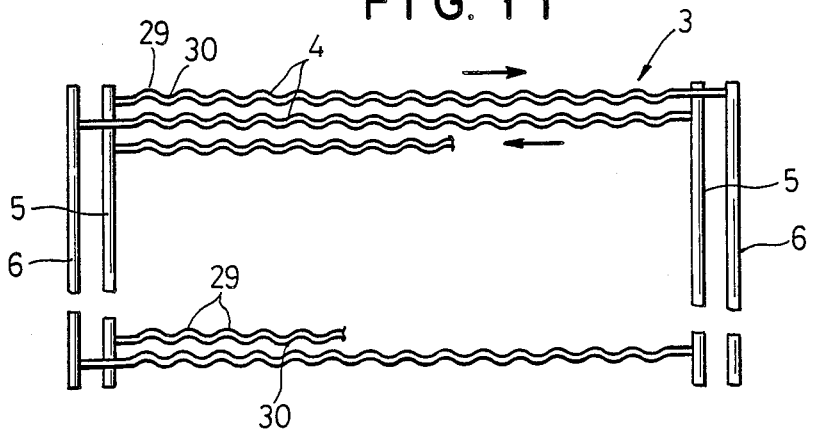
FIG. 11 is a schematic plan view of the piping arrangement unit arranged with its heat radiation pipe being curved in a wave form.
Figure 12:
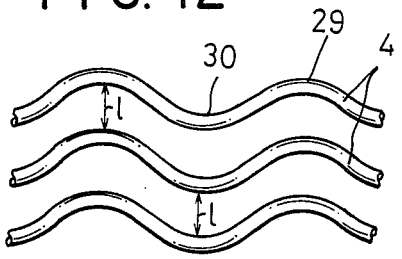
FIG. 12 is a partial enlarged plan view of FIG. 11.
Figure 13:
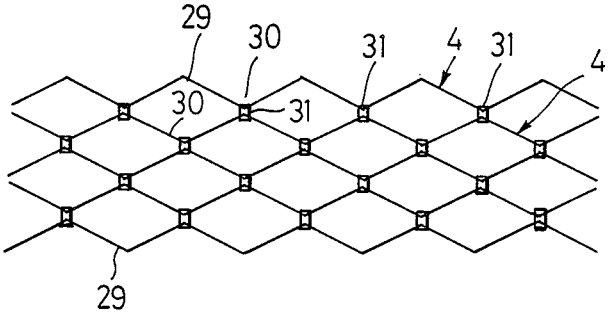
FIG. 13 is a plan view showing another method of arranging the heat radiation pipe curved in a wave form.

Furthermore, the heating pipes 4 need not be in perfectly straight form, and are elongated in the same direction. For example, they may be shaped in a wave-like form with their peaks 29 and valleys 30 appearing alternately as shown in FIGS. 11 to 12. In FIGS. 11 and 12, the phase of the peaks 29 and valleys 30 of the adjacent heat radiation pipes 4 are in conformity with one another and the spacing l between the heat radiation pipes 4 and 4 is substantially constant throughout their full length. A wave-like heat radiation pipe 4 that is bent in advance may be transported and buried at the site or a straight synthetic resin pipe or soft steel pipe having flexibility may be bent and buried at the site. One of the ends of each of a large number of the wave-like heat radiation pipes is connected to the inlet side header 5 with the other end, to the outlet side header 6, thereby constituting the piping arrangement unit 3. FIG. 13 shows an embodiment wherein the phases of the peaks 29 and valleys 30 of mutually adjacent heat radiation pipes 4 are deviated from one another and these pipes 4 are coupled by clip-like connection members 31 to obtain a net-like piping arrangement.

If the heat radiation pipes 4 . . . are buried in the corrugated form as shown in FIGS. 11 to 13, the heating medium flows zigzag and in the wave-like form in accordance with the shape of the heat radiation pipe 4 so that the place where the piping arrangement unit 3 is heated substantially uniformly. The arrangement of a large number of wave-like heat radiation pipes 4 is particularly suitable for melting the fallen snow and/or preventing freezing of the road surface. If pipes 4 shaped in a wave-like form are used, even if the spacing l between the heat radiation pipes 4 and 4 is enlarged, the snow and ice do not remain on the road surface 2. Even if they do, the snow and ice is easily melted by tires of travelling cars thereon, and the like.

Figure 14:
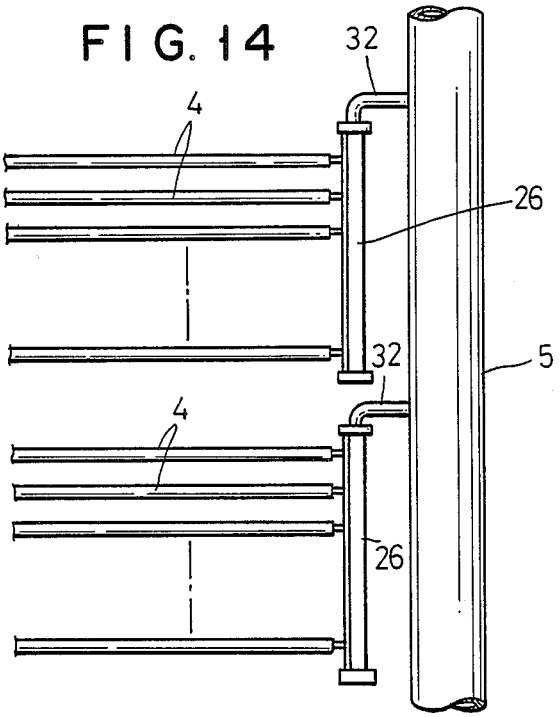
FIG. 14 is a schematic plan view showing an example of the connection method of the heat radiation pipe curved in a wave form.

Connection of each heat radiation pipe 4 to the inlet side header 5 or the outlet side header 6 may be made by directly connected the end of each heat radiation pipe 4 to each header 5, 6 but it may be connected by use of an auxiliary connection member 26 such as a sub-header shown in FIG. 14. When such an auxiliary connection member 26 is used, a large number of heat radiation pipes 4 are connected in advance to the auxiliary connection member 26 and this auxiliary connection member 26 is connected to each header 5, 6, thereby completing the connection of the heat radiation pipes 4. In this manner, the piping arrangement work can be drastically reduced. The connection method between the headers 5, 6 and the auxiliary connection member or the heat radiation pipes 4 described above can be made by disposing joints 33 having cocks 32 on the headers 5, 6.

Figure 15:
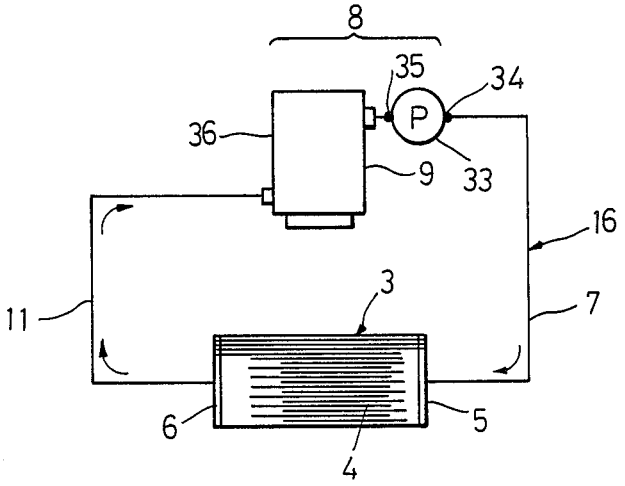
FIG. 15 is another schematic system diagram of the piping apparatus in accordance with the present invention.
Figure 16:
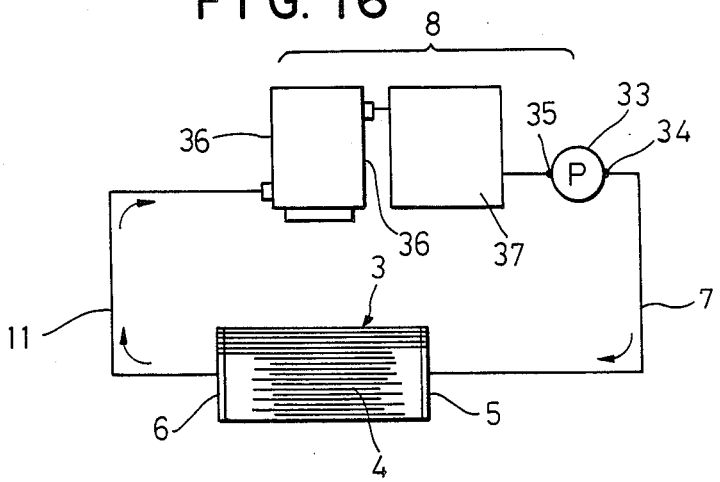
FIG. 16 is still another schematic system diagram of the piping apparatus of the present invention.

The inlet side header 5 of the piping arrangement unit 3 constructed in the manner described above is connected to the feed side of the heating medium supply means 8 through the feed pipe 7. In FIG. 1, the boiler 9 and the pump 12 are shown as the heating medium supply means 8 and the inlet side header 5 is shown connected to the outlet 10 of the boiler 9 as the heating medium supply means through the feed pipe 7. However, it is possible to connect the inlet side header 5 to the discharge port 34 of the pump 33 as the heating medium supply means through the feed pipe 7 and then to connect the suction port 35 of the pump 33 to heating medium generation source 36 such as a boiler as shown in FIG. 15. Still alternatively, it is possible to dispose a tank 37 inside the heating medium supply means and to connect the feed pipe 7 to the outlet 38 of the tank 37 as shown in FIG. 16. The outlet side header 6 of the piping arrangement unit 3 is preferably connected to the heating medium supply means 8 preferably through the return pipe 11 so as to circulate the heating medium. When gushing-out hot spring water is used as the heating medium, for example, the heating medium may be discharged from the outlet side header 6 through suitable discharge means. Besides the hot water, hot brine or the like can be used as the heating medium without any particular limitation.

Figure 17:
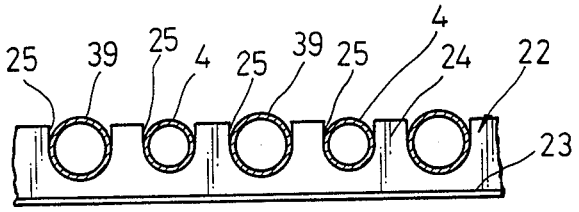
FIG. 17 is a schematic sectional view useful for explaining a method of disposing a heat retaining member.

In the present invention, heat retaining members 39, shaped in a pipe form, storing therein a heat accumulation material can be disposed between and in parallel with the heat radiation pipes 4 . . . with suitable equal gaps as shown in FIG. 17. Each heat retaining member 39 consists of a metallic or synthetic resin pipe, for example, and a heat accumulation material stored inside the pipe. Both ends of the heat retaining member 39 are sealed. As the heat accumulation material, it is possible to use an aqueous solution of sodium phosphate or sodium acetate, or these aqueous solutions to which sodium fluoride is added. These heat accumulation materials have a relatively low melting point, store a large quantity of heat at the time of phase change from the solid to the liquid and emit a large quantity of heat at the time of phase change from the liquid to the solid. Therefore, if the heat retaining members 39 storing therein the heat accumulation material are disposed suitably between the heat radiation pipes 4, the heat accumulation material inside the heat retaining members 39 absorbs a large quantity of the heat when the heating medium flows, so that even when the temperature of the road surface 2 drops below a predetermined temperature, it can be prevented from dropping further for a predetermined period due to the latent heat of the heat accumulation material. Therefore, even when the pump 12 is stopped to stop the supply of the heating medium, the road surface can be kept under the heated state. When the temperature of the road surface 2 drops below the predetermined temperature after the passage of the predetermined period, the pump 12 is again operated to supply the heating medium and to prevent the freeze. In this manner, the heated state can be maintained for the predetermined time by the latent heat of the heat accumulation material without operating always the pump 12.

Figure 18A:
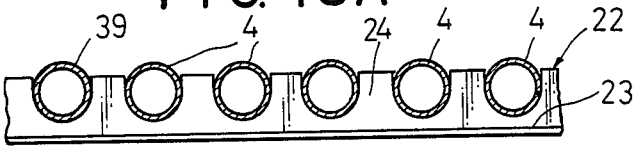
Figure 18B:
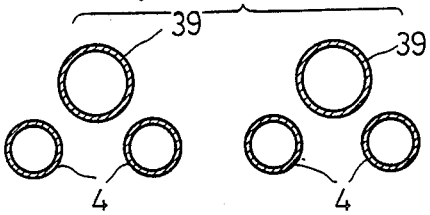
Figure 18D:
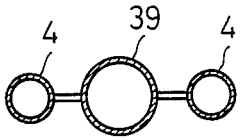
Figure 18C:
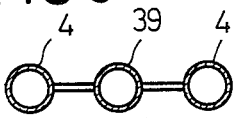
Figure 18E:
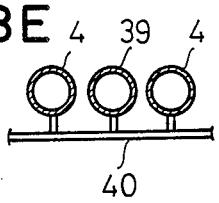
Figure 18F:
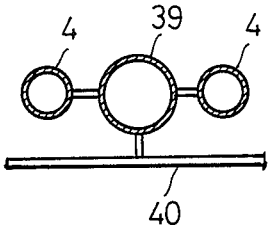

Incidentally, the structure of disposition of the heat radiation pipes 4 . . . and the heat retaining members 39 . . . is not particularly limited to the example shown in FIG. 17. For example, the structures shown in FIGS. 18(A) to 18(F) can be employed, too. In FIG. 18(A), one heat retaining member 39 is arranged parallel for a plurality (3, for example) of heat radiation pipes 4. In FIG. 18(B), one heat retaining member 39 is disposed parallel above two heat radiation pipes 4, 4. In FIGS. 18(C) and (D), one heat retaining member 39 is disposed between two heat radiation pipes 4 and 4 in one unit. This structure makes it possible to simultaneously arrange the heat radiation pipes 4 and the heat retaining members 39 and to improve workability of piping arrangement. In FIGS. 18(E) and (F), a support 40 is shown disposed integrally with the heat radiation pipes 4, 4 and with the heat retaining member 39 to constitute a unit. This structure can improve workability of the piping arrangement in the same way as in FIGS. 18(C) and (D).

If the heat retaining member 39 for storing the heat accumulation material is molded in a tube whose both ends are sealed, however, a piping arrangement such as plane arrangement, vertical arrangement, curved arrangement, or the like becomes possible without limitation, and it can be easily constituted as a unit together with the heat radiation pipes and the heat retaining members.

In the embodiment described above, the piping arrangement unit is directly buried below the road surface. However, it is possible to arrange reinforcing beams of metal or concrete between the heat radiation pipes 4 and 4 in order to prevent damage and breakage of the piping arrangement unit 3 due to the weight of travelling vehicles.

Figure 19:
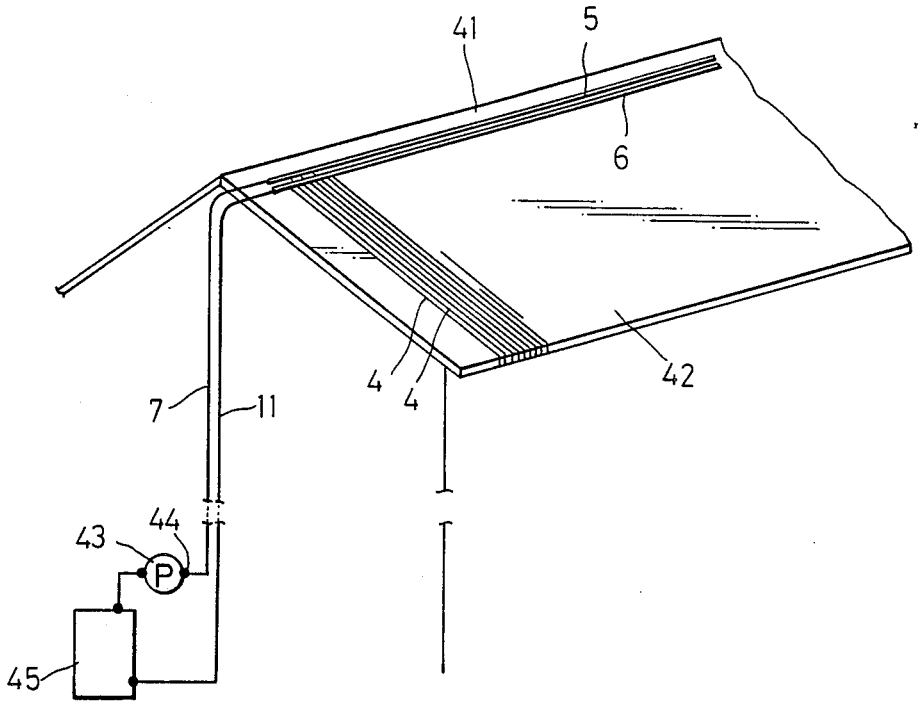
FIG. 19 is a schematic perspective view when the piping apparatus of the present invention is applied to a roof.
Figure 20A:
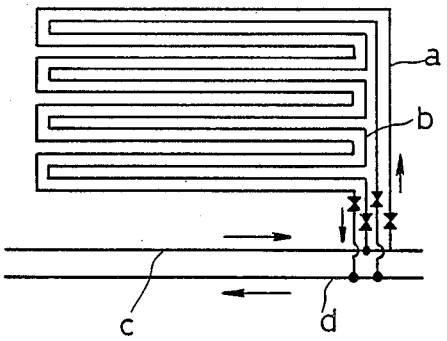
FIG. 20A (PRIOR ART)
FIG. 20A and B are explanatory views of an example of conventional road heater apparatuses.
Figure 20B:
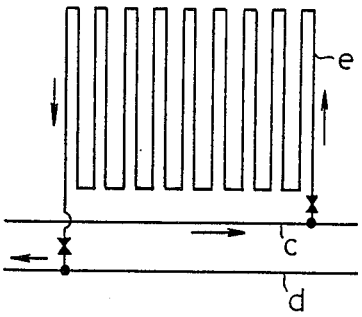
FIG. 20B (PRIOR ART)

Besides the road, the present invention can be applied to melting of ice and snow on the bridge, the roof of a house, a parking lot, a snow dumping facility, a ground, or the like. FIG. 19 shows another embodiment of the present invention which is applied to melting of snow and ice on the roof. In FIG. 19, reference numeral 41 represents the roof. A large number of heat radiation pipes 4 . . . are juxtaposed in parallel with one another and spaced equidistantly from one another at the base portion 42 of the roof 41 along the slope of the roof. The inlet side headers 5 and the outlet headers 6 are juxtaposed in a direction substantially orthogonal to the heat radiation pipes 4. These heat radiation pipes 4 are bent at the center in the U-shape, and one of the ends of each heat radiation pipe 4 is connected to the inlet side header 5 with the other, to the outlet side header 6. The bent portion of each heat radiation pipe 4 is secured to the lower edge side of the base portion 42 by suitable means. The inlet side header 5 is connected to the discharge port 44 of the pump 43 as the heating medium supply means through the feed pipe 7 and a suction part of the pump 43 is further connected to the boiler 45.

Therefore, the hot water produced by the boiler 45 is caused to flow through the heat radiation pipes 4 . . . when the pump 43 is driven, and heats the roof.

In accordance with the present invention as described above, a large number of heat radiation pipes for passing the heating medium are arranged above or below the base portion of the desired surface where snow and ice are to be melted, and can prevent freezing and fallen snow even in a cold district and rapidly melt the frozen ice or fallen snow. Therefore, the present invention is more economical than the conventional sprinkler system or calcium chloride scatter system and can be used semipermanently. Moreover, in accordance with the present invention, the piping arrangement units are merely laid down above or below the surface, it can be manufactured and operated at a reduced cost, and the snow and ice can be melted uniformly. Furthermore, any damage and breakage of heat radiation pipes can be found out easily, the repair work can be made easily and complicated works of inspection and maintenance can be eliminated.

What is claimed is:

1. A piping apparatus for melting snow and ice, comprising:

a large number of elongated heat radiation pipes juxtaposed adjacent to and beneath a surface from which snow and ice are to be melted and removed, said pipes being disposed substantially in parallel and substantially equidistantly with respect to one another in the longitudinal direction thereof and each of said heat radiation pipes having two opposite ends which are selectively inlet and outlet ends;

an inlet side header disposed in a direction substantially orthogonal to said elongated heat radiation pipes and being connected to an inlet end of each of said heat radiation pipes;

an outlet side header disposed in a direction substantially orthogonal to said elongated heat radiation pipes and being connected to an outlet end of each of said heat radiation pipes;

said elongated heating pipes and said inlet and outlet side headers forming a generally rectangular unit;

a feed pipe having first and second ends, said first end of which is connected to said inlet side header;

heating medium supply means including a heating medium generator and a pump, said heating medium supply means being connected to said feed pipe only at said second end of said feed pipe for supplying a heating medium to said heat radiation pipes via said feed pipe and inlet side header, and for causing said heating medium to flow through said heat radiation pipes under the influence of said pump; and tubular heat retaining members storing therein an aqueous solution of sodium phosphate as a heat accumulation material, said tubular heat retaining members being disposed in the proximity of, and substantially in parallel with, at least a number of said heat radiation pipes.

2. A piping apparatus for melting snow and ice, comprising:

a large number of elongated heat radiation pipes juxtaposed adjacent to and beneath a surface from which snow and ice are to be melted and removed, said pipes being disposed substantially in parallel and substantially equidistantly with respect to one another in the longitudinal direction thereof and each of said heat radiation pipes having two opposite ends which are selectively inlet and outlet ends;

an inlet side header disposed in a direction substantially orthogonal to said elongated heat radiation pipes and being connected to an inlet end of each of said heat radiation pipes;

an outlet side header disposed in a direction substantially orthogonal to said elongated heat radiation pipes and being connected to an outlet end of each of said heat radiation pipes;

said elongated heating pipes and said inlet and outlet side headers forming a generally rectangular unit;

a feed pipe having first and second ends, said first end of which is connected to said inlet side header;

heating medium supply means including a heating medium generator and a pump, said heating medium supply means being connected to said feed pipe only at said second end of said feed pipe for supplying a heating medium to said heat radiation pipes via said feed pipe and inlet side header, and for causing said heating medium to flow through said heat radiation pipes under the influence of said pump; and tubular heat retaining members storing therein an aqueous solution of sodium phosphate as a heat accumulation material, said tubular heat retaining members being disposed in the proximity of, and substantially in parallel with, at least a number of said heat radiation pipes.

3. The apparatus for melting snow and ice as defined in claim 1 or 2, wherein each of said heat radiation pipes is made of a metal, and at least the outer surface of each of said heat radiation pipes is coated with a synthetic resin coating film.

4. The apparatus for melting snow and ice as defined in claim 1 or 2, wherein each of said heat radiation pipes is made of a synthetic resin having corrosion resistance.

5. The piping apparatus for melting snow and ice as defined in claim 1 or 2, wherein said surface is a road surface, and said heat radiation pipes are each arranged in a straight form and are disposed below said road surface substantially in parallel therewith.

6. The piping apparatus for melting snow and ice as defined in claim 1 or 2, wherein said surface is a road surface, and said heat radiation pipes are disposed below said surface in a wave-like form.

7. The piping apparatus for melting snow and ice as defined in claim 1 or 2, wherein each of said heat radiation pipes is a seamless soft metal pipe from its end connected to said inlet side header to its other end connected to said outlet side header.

8. The piping apparatus for melting snow and ice as defined in claim 1 or 2, wherein said heat radiation pipes comprise respective pairs of adjacent parallel pipes joined together.

9. The piping apparatus for melting snow and ice as defined in claim 1 or 2, wherein said heat radiation pipes are disposed in such a manner that the flowing directions of said heating medium flowing therethrough are opposite for a plurality of said heat radiation pipes.

10. The piping apparatus for melting snow and ice as defined in claim 1 or 2, further comprising spacer means disposed substantially orthogonal to said heat radiation pipes for supporting a number of said radiation pipes relative to said surface.

11. The piping apparatus for melting snow and ice as defined in claim 1 or 2, wherein said heat radiation pipes are supported spaced from said surface by supports having a predetermined height.

12. The piping apparatus for melting snow and ice as defined in claim 1 or 2, wherein said heat retaining members are disposed in proximity of every other one of said heat radiation pipes.

13. The piping apparatus for melting snow and ice as defined in claim 1 or 2, wherein said generator of said heating medium supply means includes means for generating a liquid heating medium; and said pump feeds said generated liquid heating medium to said inlet side header.

14. The piping apparatus for melting snow and ice as defined in claim 13, wherein said liquid heating medium comprises hot water.

15. The piping apparatus for melting snow and ice as defined in claim 13, wherein said liquid heating medium comprises hot brine.

16. The piping apparatus for melting snow and ice as defined in claim 1 or 2, wherein said heat retaining members are disposed in proximity of every other one of a plurality of said heat radiation pipes.

17. The piping apparatus for melting snow and ice as defined in claim 1 or 2, wherein said tubular heat retaining members are molded in a tubular shape whose ends are sealed.

18. The piping apparatus for melting snow and ice as defined in claim 1 or 2, wherein said heat radiation pipes are soft metal pipes.

19. The piping apparatus for melting snow and ice as defined in claim 1 or 2, wherein said inlet side header further comprises at least one sub-header coupled to one end of each of a polarity of said heat radiation pipes, said at least one sub-header being connected to said inlet side header.

* * * * *